US005291712A

United States Patent [19]

Curran

[11] Patent Number: 5,291,712

[45] Date of Patent: Mar. 8, 1994

[54] VAPOR PERMEABLE SHINGLES AND UNDERLAYMENT SHEETING FOR A ROOF COVERING

[76] Inventor: Laurence E. Curran, P.O. Box 991, Kennebunkport, Me. 04046

[21] Appl. No.: 51,620

[22] Filed: Apr. 22, 1993

Related U.S. Application Data

[63] Continuation-in-part of Ser. No. 738,832, Aug. 1, 1991, abandoned.

[51] Int. Cl.[5] ..... E04D 1/00

[52] U.S. Cl. ..... 52/526; 52/409; 52/302.1; 428/137

[58] Field of Search ..... 52/407, 408, 409, 199, 52/518, 526, 530, 533, 534, 302.1; 428/138, 137, 141

[56] References Cited

U.S. PATENT DOCUMENTS

| | | | |
|---|---|---|---|
| 2,096,784 | 7/1934 | Candler | 52/533 |
| 2,122,747 | 7/1938 | Kirschbraun | 52/533 |
| 4,726,985 | 2/1988 | Fay et al. | 52/404 |

*Primary Examiner*—Carl D. Friedman
*Assistant Examiner*—Kien Nguyen
*Attorney, Agent, or Firm*—Silverman, Cass & Singer, Ltd.

[57] ABSTRACT

A vapor permeable roof covering comprised of an asphaltic-type shingle and a coated underlayment sheeting, the shingle and sheeting having an array of pierced openings therethrough spaced along the length and width thereof constructed and arranged to permit only the passage therethrough of water vapor under vapor pressure and concurrently prevent passage of liquid water therethrough.

9 Claims, 2 Drawing Sheets

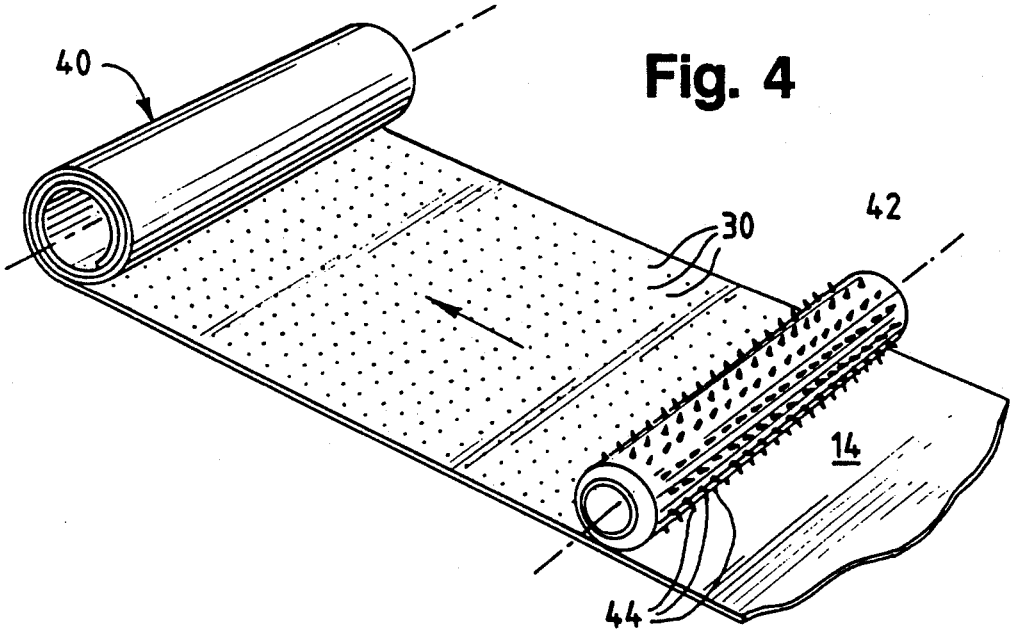
Fig. 4
Fig. 5
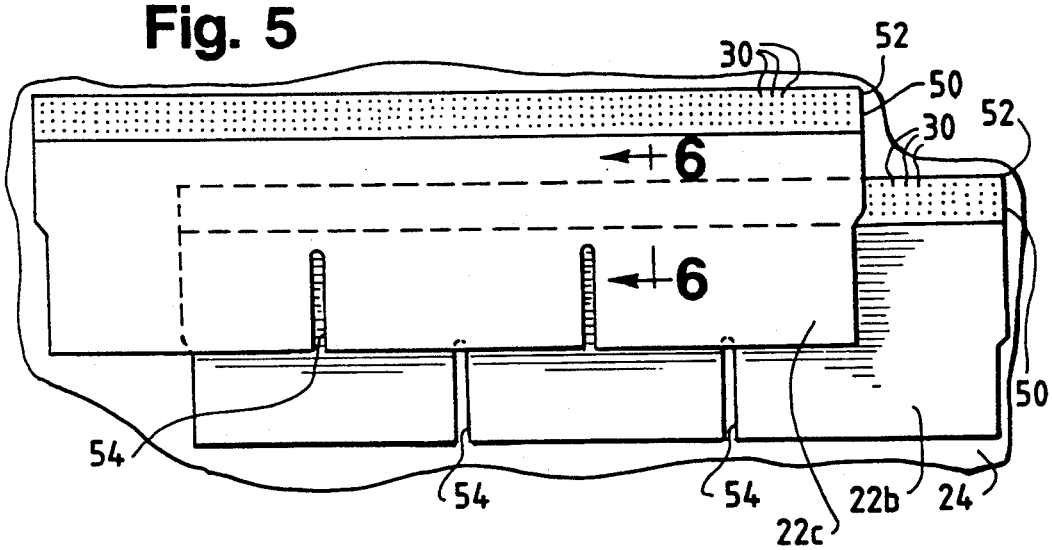
Fig. 6
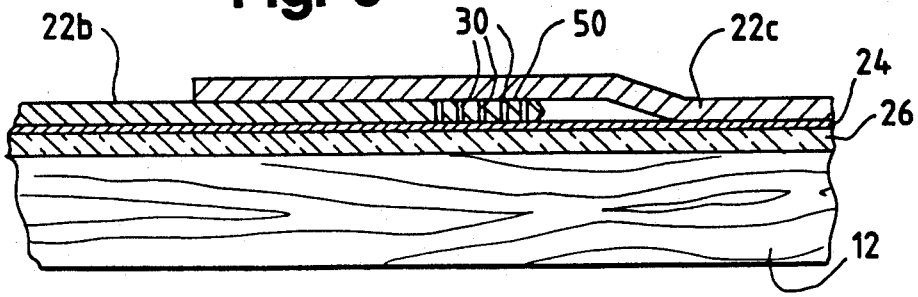

VAPOR PERMEABLE SHINGLES AND UNDERLAYMENT SHEETING FOR A ROOF COVERING

CROSS-REFERENCE TO RELATED APPLICATION

This application is a continuation-in-part of U.S. Ser. No. 07/738,832 filed Aug. 1, 1991 now abandoned the disclosure of which is incorporated herein by reference.

FIELD OF THE INVENTION

This invention relates generally to asphaltic-type shingles and coated underlayment sheeting for roofing applications, and more particularly, relates to a novel asphaltic-type shingle and coated underlayment sheeting for roofs which are specially constructed to be permeable to water vapor but impermeable to water when installed on the roof.

BACKGROUND OF THE INVENTION

Roof ridge ventilators, such as taught in U.S. Pat. No. 4,325,290, are recognized as valuable and useful roof installations for achieving desirable ventilation of the space below the roof of the building. The water vapor generated in the attic and which rises to the attic from within the building can escape through such an adequate ventilator system when in place. Of course, other roof ventilator systems of adequate construction may also function to enable escape of such water vapor in the attic or below the roof of the building.

However, such suitable ventilation systems are not used predominantly, especially in residential homes and in older buildings. The roof covering of such a building usually utilizes asphaltic-type shingles and coated underlayment sheeting and this type of roof covering is used both in new and remodeling applications. By their structural nature, such applications are intended to be waterproof so that water in liquid or vapor form will not penetrate through them. Thus, the desired characteristic of asphaltic-type roof coverings is to prevent passage therethrough of water and function as excellent vapor barriers.

This feature of conventional roof coverings contributes to a serious adverse condition in the building. For the past two decades, building construction has tended to focus on energy conservation. This focus has led to buildings that are substantially airtight, insulated and likely to permit exit of only a small amount of internally generated water vapor. For the most part, this trapped moisture driven by vapor pressure migrates to the attic where it is prevented from escaping to ambient atmosphere because of the lack of a suitable ventilation system, such as a ridge ventilator or other roof installed system. The trapped water vapor condenses to form free water on the underside of the roof and cause damage and deterioration of the structure in and below the attic.

According to the invention, there is provided a novel vapor permeable roof covering which substantially eliminates trapped moisture in an attic and significantly increases the longevity of the roof and building. The invention utilizes the considerable force of vapor pressure to enable accumulated attic vapor to exit the roof covering to ambient atmosphere and yet prevent free water from penetrating the roof covering into the attic.

SUMMARY OF THE INVENTION

One object of the invention is to provide a vapor permeable roof covering comprised of asphaltic-type shingles and coated underlayment sheeting with a selected pattern of pierced openings therethrough which normally are closed with respect to liquid water impinging thereon from ambient atmosphere but which will permit passage therethrough of water vapor under vapor pressure from the interior of a building.

Another object of the invention is to provide such a roof covering in which the openings are extremely fine and are formed without punching out or removal of material from the shingles or sheeting, said openings normally being mostly invisible and remaining normally closed due to the asphaltic nature of said roof covering so as to prevent passage of liquid water therethrough. However, said openings are capable of being forced open by vapor pressure sufficiently to permit passage of water vapor therethrough. Accordingly, each such opening functions as a one-way valve for passage of liquid vapor only therethrough in one direction.

The pattern of such pierced openings in the shingles or sheeting can be straight-line or haphazard so long as they are sufficiently numerous for desired quantification of water vapor escapement for the building.

BRIEF DESCRIPTION OF THE DRAWINGS

FIG. 4 is a diagrammatical perspective view illustrating one method of forming the pierced openings in a sheet of asphaltic shingle and/or underlayment sheeting;

FIG. 5 is a top plan view of two overlapping shingles installed on a building roof and illustrating another embodiment of the present invention; and FIG. 6 is a fragmentary cross-sectional view taken along line 6—6 of FIG. 5 and in the direction indicated.

DETAILED DESCRIPTION OF THE PREFERRED EMBODIMENTS

Figure 1:
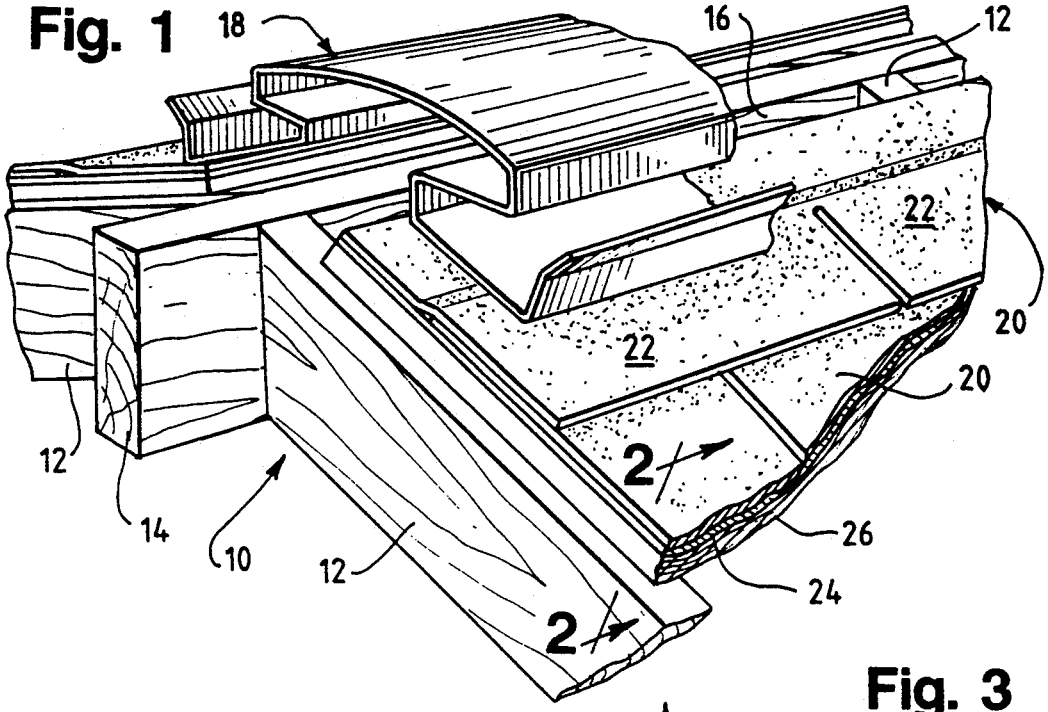
FIG. 1 is a fragmentary perspective view of a conventional roof in which a rood ridge ventilator has been installed and the roof has the shingles and underlayment sheeting embodying the invention installed thereon.

Referring to FIG. 1 of the drawing, the reference character 10 designates generally a conventional roof of a building, which may be a residential-type home, for instance. Illustrated are the rafters 12 and the ridge header beam 14. Installed over the ridge vent opening 16 of the roof is a roof ridge ventilator 18 of conventional construction as fully described and illustrated in U.S. Pat. No. 4,325,290, but lacking a fibrous filter medium of said patent. This ventilator 18 would represent a ventilation system of excellent quality which would be adequate for discharging water vapor accumulating in the attic below the roof 10. However, for purpose of the herein invention, such a roof ridge ventilator normally is absent.

The roof covering designated generally 20 in FIG. 1 embodies the principles of this invention. Said covering 20 is comprised of asphaltic-type shingles 22 and coated underlayment sheeting 24 which are layered on the sheathing 26 secured entirely across the rafters 12 to entirely cover the same. This type of roof construction is conventional.

Figure 2:
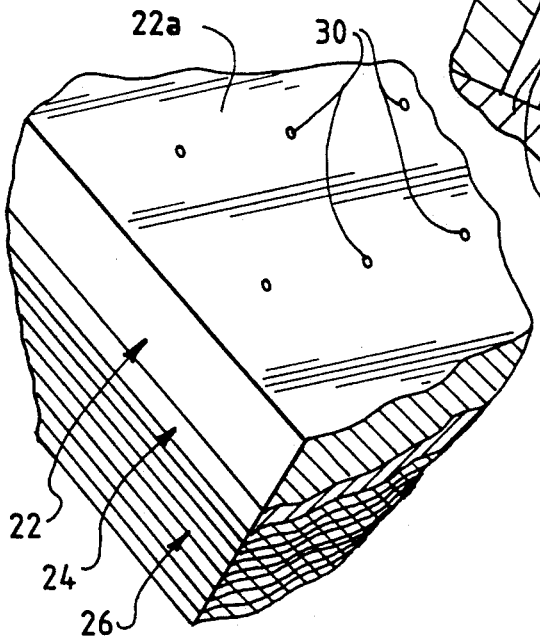
FIG. 2 is a sectional view taken along the line 2—2 of FIG. 1 and in the general direction indicated.

Referring to FIG. 2, the representative shingle 22A has a plurality of pierced or lanced openings 30 therethrough. Although not shown in FIG. 2, the underlayment sheeting 24 also will be provided with such pierced openings therethrough and extending across the length and width thereof in a selected pattern. A sufficiently large number of such openings are provided so as to be adequate for achieving the desired functions thereof.

Figure 3:
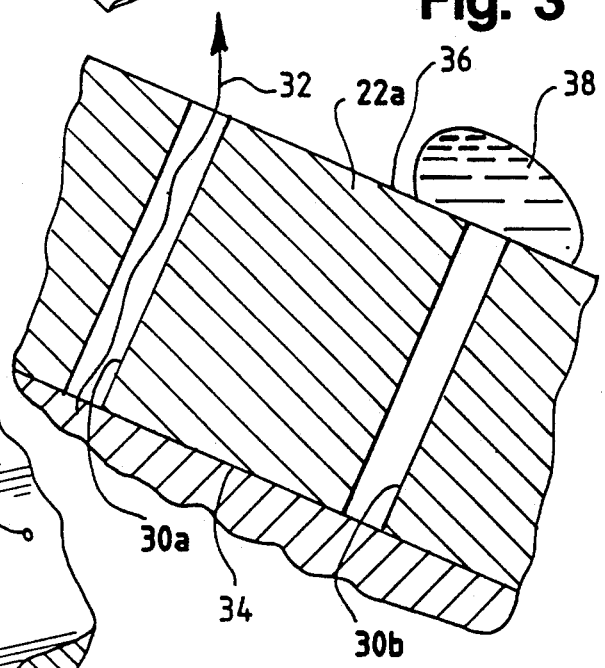
FIG. 3 is an enlarged, diagrammatical view of a shingle array and illustrating the manner in which water vapor can escape through the pierced openings and how free water is prevented from passing through such an opening.

Referring to FIG. 3, the shingle 22A is shown to illustrate the functional nature of such an opening 30. The opening 30A has been shown opened or enlarged by vapor pressure to permit water vapor represented by the arrow 32 to pass from the attic side 34 to ambient atmosphere 36. The openings in the underlayment sheeting will be opened or enlarged in the same manner. However, the opening 30B still remains sufficiently narrow or constricted so as to prevent liquid water represented by the water drop 38 from passing therethrough from the ambient atmosphere side 36 of the shingle.

Referring to FIG. 4, there is illustrated a roll 40 of underlayment sheeting 14 of conventional asphaltic coated material. Illustrated is a rotary steel die 42 with blades 44 in rotation against the sheeting to provide an array of pierced openings 30 extending across the length and width of the sheeting. The pattern of the blades 44 can be staggered or straight-lined, the blades being dimensioned merely to lance or pierce the sheeting material without removal of sheeting material. The same method of rotary punching die production can be used for the asphaltic-type shingle material. As an example only, the lines of pierced openings can be ½ inch on ½ inch center lines.

It can be appreciated that the array of pierced or lanced openings function as one-way valves which permit passage of water vapor therethrough in one direction and prevent passage of liquid water in the opposite direction.

Preferably, the pierced openings 30 substantially are circular holes having a diameter less then 0.0156" (1/64"). It is to be understood, however, that the particular size and shape of the pierced openings can vary so long as they function as described herein.

FIGS. 5 and 6 illustrate another embodiment of the present invention where similar elements are identified by the same reference numerals. In this embodiment, pierced openings 30 can be made larger than in the previous embodiment while still providing the desired venting and impermeability to water.

The openings 30 preferably are circular holes and have a diameter between 0.0156"(1/64") and 0.250"(¼"). It is to be noted, however, that the particular shape and size of the openings 30 can vary so long as they function as described herein.

In order to prevent water from entering the structure, the openings 30 in this size range only are provided along a strip 50 positioned along an inside edge 52 of each shingle 22. Thus, when the roof is completed, the strip 50 of a first shingle **22*b* is covered by a second shingle 22*c* positioned on top of the previous shingle 22*b***.

When utilizing standard shingles, the strip 50 preferably is 2" wide or less. The particular width of the strip 50 can vary, however, and the invention is not to be limited to the width thereof.

Tabs 54 of each shingle 22 do not extend across the strip 50 and, when installed, the tabs 54 of the top shingle **22*c* do not extend across the strip 50 of the bottom shingle 22*b*. Thus, water in liquid form on the building exterior does not gain access to the openings 30**.

To provide venting, water vapor flows through the openings 30 in the shingle **22*b*, for example, and either makes its way to and through a tab 54 on the outer shingle 22*c* or to the distal end of the outer shingle 22*c*. Typically, the shingles 22 are installed with nails along the longitudinal inside edge 52 proximate the strip 50 and, if desired, can be placed along the strip 50**.

It is to be noted that 4'×8' sheets of plywood typically are used for roof sheeting or decking 26 and are required by code to maintain a ⅛" spacing between sheets. It is through this spacing that the vapor pressure from within the structure tends to be channeled rather than permeating through the plywood. Thus, water vapor passes between adjacent plywood panels to first contact the coated underlayment 24, which typically is a roof felt, and then the respective shingle 22.

Accordingly, the size, number and position of the apertures 30 should be selected to enable vapor pressure to escape through the shingles 22 in proportion to the rate at which the vapor pressure passes between the free air space about the panels 26 and through the underlayment 24. To accommodate a worst case situation, the total area provided by the openings 30 should approximately equal the free air space surrounding each panel 26 without regard to the permeability of the underlayment 24.

For example, with 4'×8' plywood sheets having ⅛" spacing between the edges of each sheet, the amount of free air space surrounding each sheet is calculated to be approximately 18 sq. in. Thus, if approximately 25.6 shingles are required to cover one sheet of plywood, then each shingle preferably should contain enough apertures to provide through areas equal to approximately, 0.703125 sq. in.

Accordingly, if ⅛" diameter holes are utilized, approximately 57 holes per shingle are required. With 1/16" diameter holes are utilized, approximately 229 holes per shingle are required. In either event, the larger holes preferably are provided only along the strip 50.

Modifications and variations of the present invention are possible in light of the above teachings. A specific dimension, material or construction is not required so long as the assembled device is able to function as described herein. It therefore is to be understood that within the scope of the appended claims, the invention may be practiced otherwise than specifically described.

What is claimed and desired to be secured by letters patent is:

1. A vapor permeable roof covering comprising, in combination, an array of asphaltic-type roof shingles and coated underlayment sheeting, said shingles and sheeting each having a pattern of pierced openings therethrough spaced along the length and width thereof, each of said openings functioning as a one-way valve which permits passage of water vapor therethrough under vapor pressure and concurrently prevents passage therethrough of liquid water.

2. The roof covering of claim 1 in which said pierced openings are formed without removal of material from which the shingles and sheeting are formed.

3. The roof covering of claim 1 wherein said pierced openings of said shingles are provided along a longitudinal edge of each shingle and extend across a predetermined width of each shingle, said predetermined width being less than the entire width of said shingle.

4. The roof covering of claim 3 wherein the size, number and position of said pierced openings are selected in proportion to the rate upon which vapor pressure impinges on said shingles.

5. A vapor permeable asphaltic-type shingle for a roof covering, said shingle having a series of pierced perforations therethrough spaced along the length and width thereof, said perforations functioning as one-way valves for permitting only passage therethrough of water vapor under pressure and preventing passage of liquid water.

6. The shingle of claim 5 in which said perforations are formed without removal of material from the shingle.

7. The shingle according to claim 5 for installation in a roof covering which includes a coated underlayment sheeting having perforation functioning as one-way valves.

8. The shingle of claim 5 wherein said series of perforations is provided along a longitudinal edge of each shingle and extends across a predetermined width of each shingle, said predetermined width being less than the entire width of said shingle.

9. The shingle of claim 8 wherein the size, number and position of said perforations are selected in proportion to the rate upon which vapor pressure impinges on said shingle.

* * * * *

UNITED STATES PATENT AND TRADEMARK OFFICE

CERTIFICATE OF CORRECTION

PATENT NO. : 5,291,712

DATED : March 8, 1994

INVENTOR(S) : Laurence E. Curran

It is certified that error appears in the above-indentified patent and that said Letters Patent is hereby corrected as shown below:

Column 6, line 6, change "perforation" to --perforations--.

Signed and Sealed this

Twenty-eighth Day of June, 1994

*Attest:*

Bruce Lehman

BRUCE LEHMAN

*Attesting Officer*

*Commissioner of Patents and Trademarks*